US006485105B1

(12) United States Patent
Harris et al.

(10) Patent No.: US 6,485,105 B1
(45) Date of Patent: Nov. 26, 2002

(54) METHOD OF BRISTLE INSERTION FOR BRUSH PRODUCTION

(75) Inventors: David E. Harris, Kingsport, TN (US); Kenan Bible, Del Rio, TN (US); James Collins, Greeneville, TN (US); Lloyd Etter, Morristown, TN (US); Ed Wilson, Loves Park, IL (US); Toby Henderson, Rockford, IL (US); Dave Gierczak, Machesney Park, IL (US)

(73) Assignee: Moll Industries, Inc., Morristown, TN (US)

( * ) Notice: Subject to any disclaimer, the term of this patent is extended or adjusted under 35 U.S.C. 154(b) by 0 days.

(21) Appl. No.: 09/495,580

(22) Filed: Feb. 1, 2000

(51) Int. Cl.[7] ..... A46D 3/00; A46D 3/08

(52) U.S. Cl. ..... 300/21; 300/2; 300/4; 300/7

(58) Field of Search ..... 300/2, 4, 5, 7, 300/21

(56) References Cited

U.S. PATENT DOCUMENTS 4,609,228 A 9/1986 Bickel 4,749,233 A * 6/1988 Weihrauch

FOREIGN PATENT DOCUMENTS

| | | |
|---|---|---|
| DE | 28 49 510 | 6/1980 |
| DE | 44 20 757 | 12/1995 |
| FR | 1 133 844 | 4/1957 |
| JP | 184913 | 7/2000 |

* cited by examiner

*Primary Examiner*—Randall E. Chin
(74) *Attorney, Agent, or Firm*—Choate, Hall & Stewart; Valarie B. Rosen

(57) ABSTRACT

A method and apparatus for feeding bristle bundle material into a magazine. The magazine is used in the production of brushes in which not all the bristle bundles extend in the same direction from the face of the brush. The feed apparatus for guiding the bristle bundle material from a supply to the magazine includes a number of transition plates having channels machined at an oblique angle to the surface of the plate. The plates each guide the bristle bundle material through a small angle; the assembled plates can guide the material through a large total angle so that the angle at which the bristle bundles enter the magazine is the same as the angle the bristles will have with respect to the brush.

15 Claims, 5 Drawing Sheets

METHOD OF BRISTLE INSERTION FOR BRUSH PRODUCTION

FIELD OF THE INVENTION

This invention is related to a method of inserting bristles into a brush and, more specifically, to a method for inserting bristles which are not oriented perpendicular to the surface of the brush.

BACKGROUND OF THE INVENTION

The variety of brands, designs, and styles of toothbrushes available in the United States today is truly staggering. Brushes are available in sizes and styles appropriate for babies, adults, dentures, sensitive gums, and other specialized needs. As consumers become more concerned about oral hygiene, manufacturers have designed brushes whose bristles are optimized to reach and clean the irregular surfaces of the teeth. The bristles of these new brushes are in bundles of different sizes and shapes and are frequently oriented at an angle other than 90° with respect to the face of the brush. While these brushes may be more effective at cleaning teeth, the various angles at which the bristles are inserted can make manufacturing difficult. In automated machinery, material is typically fed into an apparatus from a single supply at a singe orientation with respect to the apparatus. A mechanism is necessary which can vary the orientation of the material as it is fed into a machine.

SUMMARY OF THE INVENTION

In one aspect, the invention is a method for feeding bristle bundles into a magazine comprising the steps of passing bristle bundle material into a plurality of channels in the feedblock, passing the bristle bundle material from the channels in the feedblock into corresponding adjacent channels in a first transition plate, and passing the bristle bundle material from the channels in the first transition plate into a set of corresponding channels in the magazine. The channels in the feedblock are parallel to one another and at least a portion of the channels in the first transition plate are not parallel to the channels in the feedblock. The method may further comprise passing the bristle bundle material from the channels in the first transition plate into a set of corresponding channels in a second transition plate abutting the first transition plate. At least a portion of the channels in the second transition plate are not parallel to the corresponding channels in the first transition plate. The orientation of at least a portion of the channels in the second transition plate may be offset from an orientation of the channels in the feedblock by a first angle and from an orientation of the channels in the first transition plate by a second angle. The method may further comprise repeating the passing step with at least a subsequent transition plate. A portion of the channels in the magazine may be skewed with respect to one another or lie in intersecting planes. The orientation of a portion of the channels in the first transition plate and the orientation of the channels in the feedblock may be offset by an angle greater than 0°. The channels of the feedblock and the channels of the first transition plate may have a first and a second end, and the first end of each of the channels, from which the bristle bundle material passes to the second end, may have a chamfer to increase the diameter of a portion of the channel.

In another aspect, the invention is an apparatus for feeding bristle bundles into a magazine from a supply. The apparatus includes a feedblock, parallel channels in the feedblock for receiving bristle bundle material from a supply, a first transition plate abutting the feedblock, corresponding channels in the first transition plate to receive the bristle bundle material from the channels in the feedblock, and corresponding channels in the magazine which receive the bristle bundle material which has been passed through the first transition plate. At least a portion of the channels in the feedblock are not parallel to the corresponding channels in the first transition plate. The apparatus may further comprise an additional transition plate interposed between the feedblock and the magazine, wherein the bristle bundle material can be passed from the channels in the feedblock into the corresponding channels in the magazine via the channels in the transition plates. A portion of the channels in the additional transition plate are not parallel to the corresponding channels in the feedblock or the first transition plate. An orientation of at least a portion of the channels in the additional transition plate are offset from an orientation of the channels in the feedblock by a first angle and from an orientation of the channels in the second transition plate by a second angle. The apparatus may further comprise a plurality of additional transition plates. The channels of the feedblock and the channels of the first transition plate may each have a first and second end. The bristle bundle material passes from the first end of the channels to the second end, and the first end of each of the channels may have a chamfer to increase the diameter of a portion of the channel. The channels in the first transition plate may not all be parallel to one another, and an orientation of a portion of the channels in the first transition plate and an orientation of the corresponding channels in the feedblock may be offset by an angle greater than 0°. A portion of the channels in the magazine may be skewed with respect to one another or lie in intersecting planes.

BRIEF DESCRIPTION OF THE DRAWING The invention is described with reference to the several figures of the drawing, in which, FIG. 1A is a side view of a bristle feeding apparatus and a magazine;

FIGS. 4A–E are diagrams of a set of transition plates showing the angles of channels in the plates with respect to the plates.

DETAILED DESCRIPTION

Figure 1B:
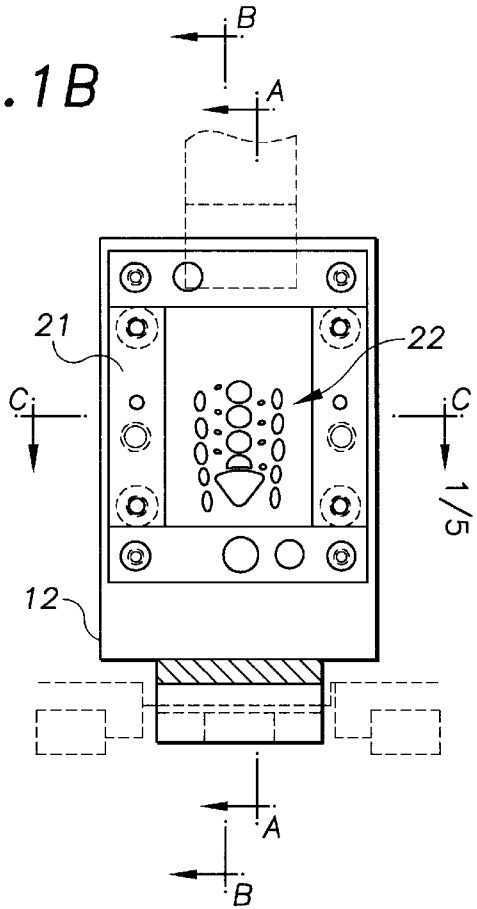
FIG. 1B is a front view of a portion of the magazine.
Figure 1A:
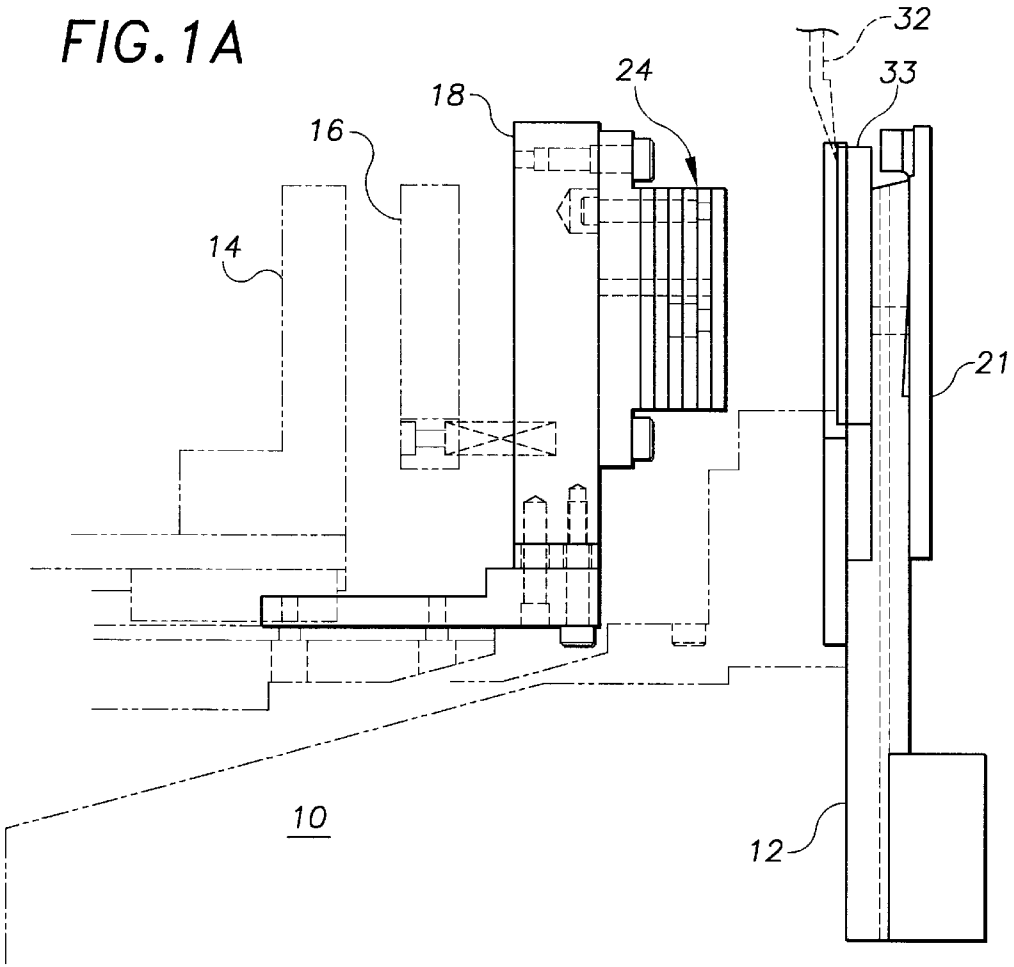

FIG. 1A depicts a side view of an apparatus for feeding bristle bundle material into a magazine. The material is passed through a three-part feed system 10 into a magazine 12, which carries the bristle bundles along a processing path. Bristle bundle material from an endless supply, such as a creel system, is passed into channels in a fixed clamp 14. From the fixed clamp 14, the material passes into adjacent sets of channels in moving clamp 16 and feedblock 18, which also includes a clamp. Fixed clamp 14, moving clamp 16, and feedblock 18 all have a set of channels configured such that bristle bundle material can pass from a channel in, for example, moving clamp 16, to a corresponding channel in feedblock 18 as it is conducted through the apparatus to the corresponding channels in the magazine 12. Up until this point, all the channels have been parallel to one another, and the corresponding channels in fixed clamp 14, moving clamp 16, and feedblock 18 are collinear. From feedblock 18, the bristle bundle material passes into a series of transition plates 24. The transition plates 24 gradually change the orientation of the various bristle bundle strands. For example, for the brush shown in FIG. 2, some of the bristle bundles (e.g., 34, 36, and 44) are oriented at angles away from the brushhead, some (e.g., 38) are perpendicular to the face of the brash, and some of the bristle bundles (e.g., 40 and 42), while they lie in parallel planes, are skewed with respect to each other, In other words, the bristle bundles 40 are not parallel to bristle bundles 42 but do not lie in intersecting planes. FIG. 1B depicts a front side 21 of magazine 12, showing where the bristle bundles will emerge from channels 22 to be affixed to a brush handle.

Figure 2:
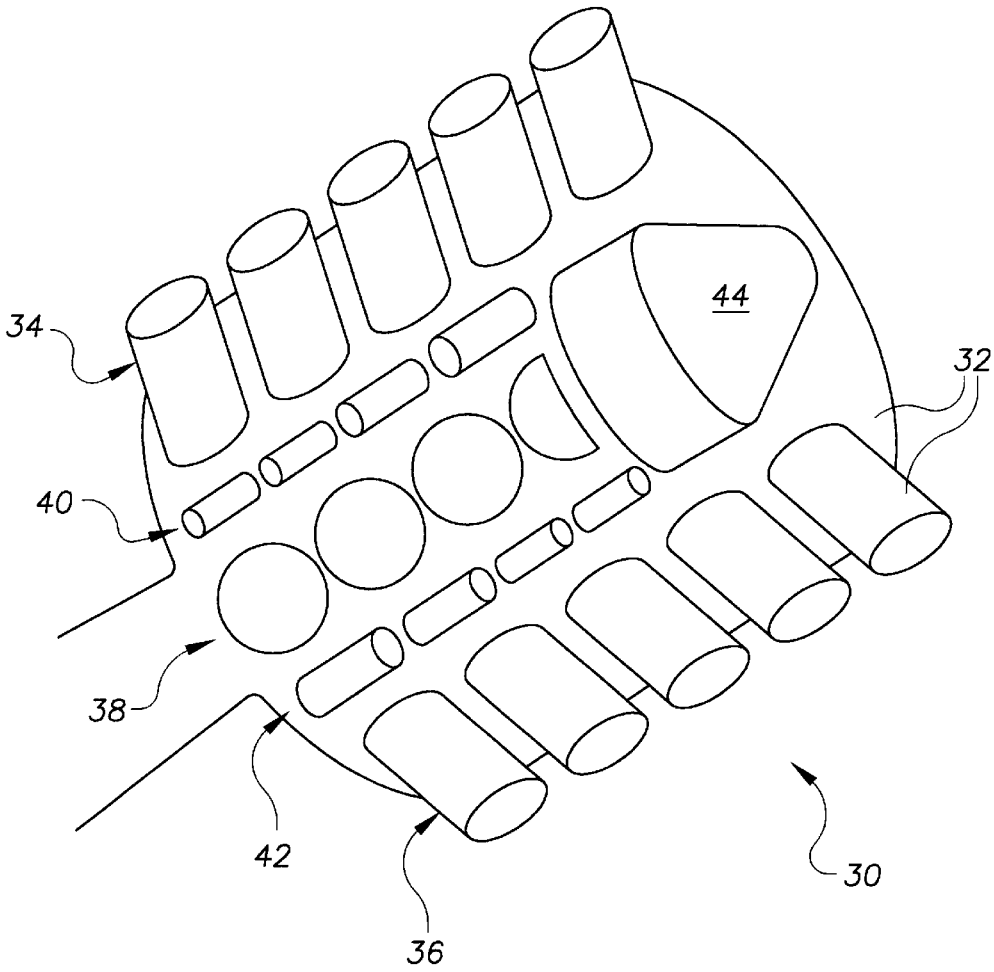
FIG. 2 is a top view of a toothbrush head.
Figure 3B:
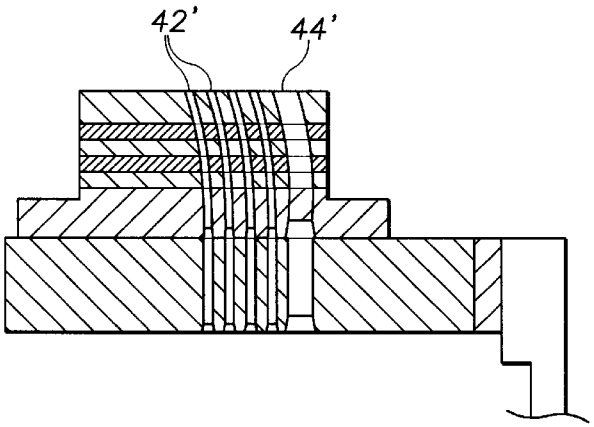
FIGS. 3A and 3B are cross-sectional views cut from the side of a feedblock and a set of transition plates.
Figure 3D:
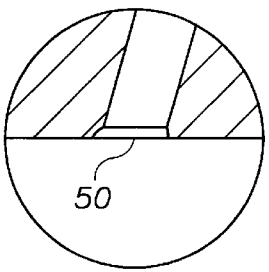
FIG. 3D is an exploded view of a chamber in a transition plate.
Figure 3A:
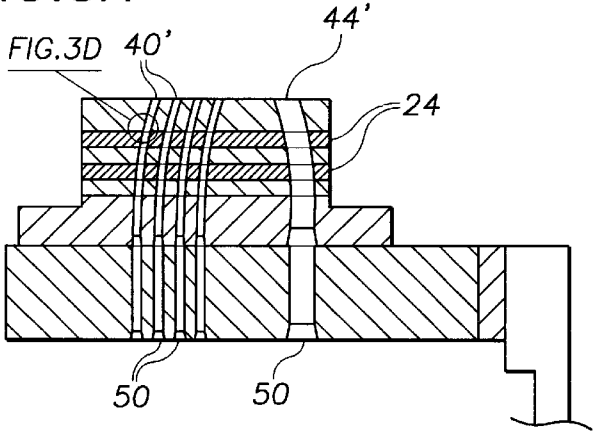
Figure 3C:
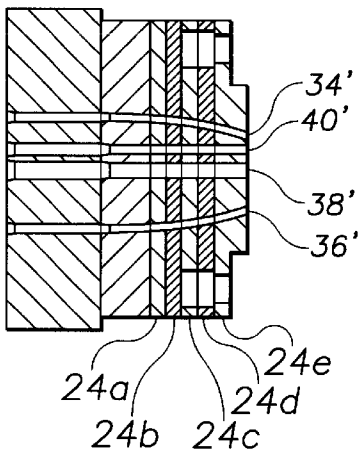
FIG. 3C is a cross-sectional view cut from the top of a feedblock and a set of transition plates; .
Figure 4B:
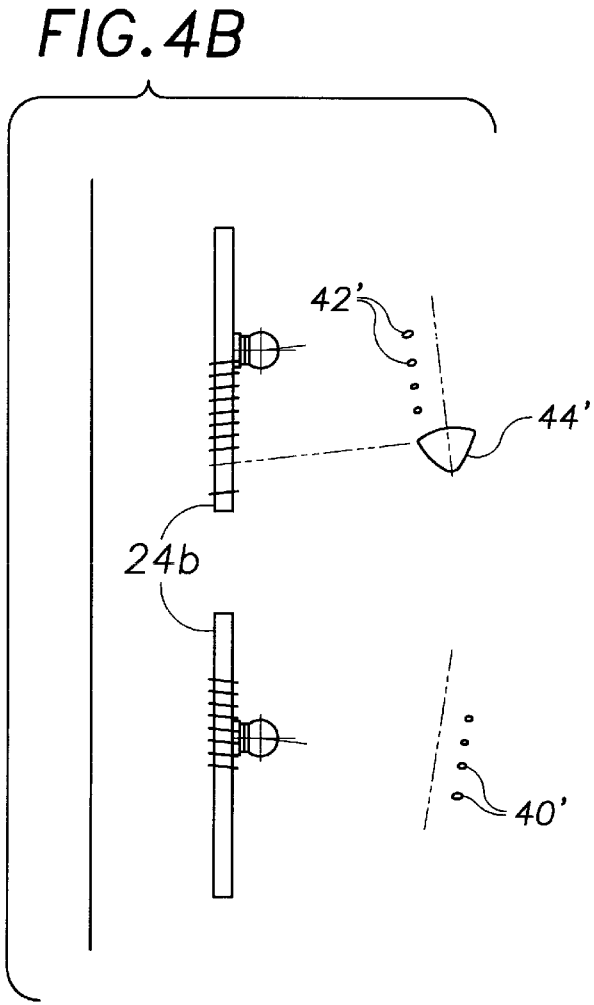
Figure 4A:
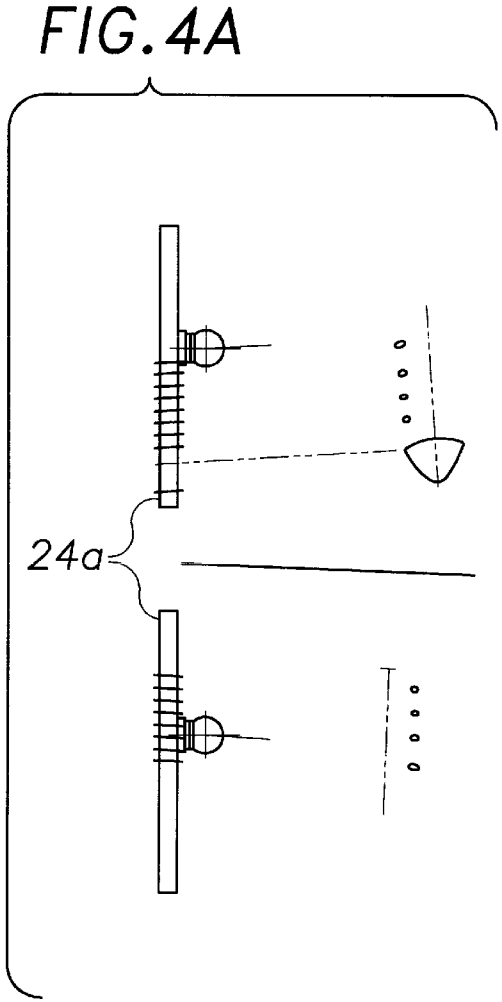
Figure 4E:
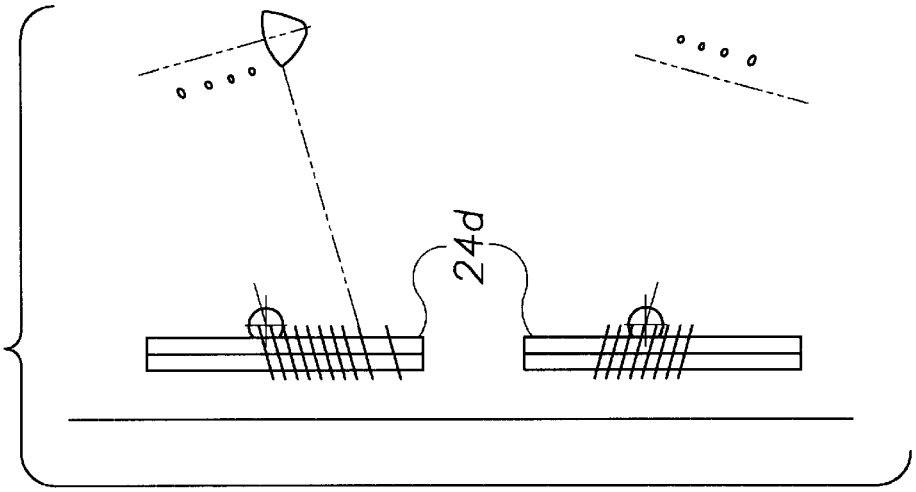
Figure 4D:
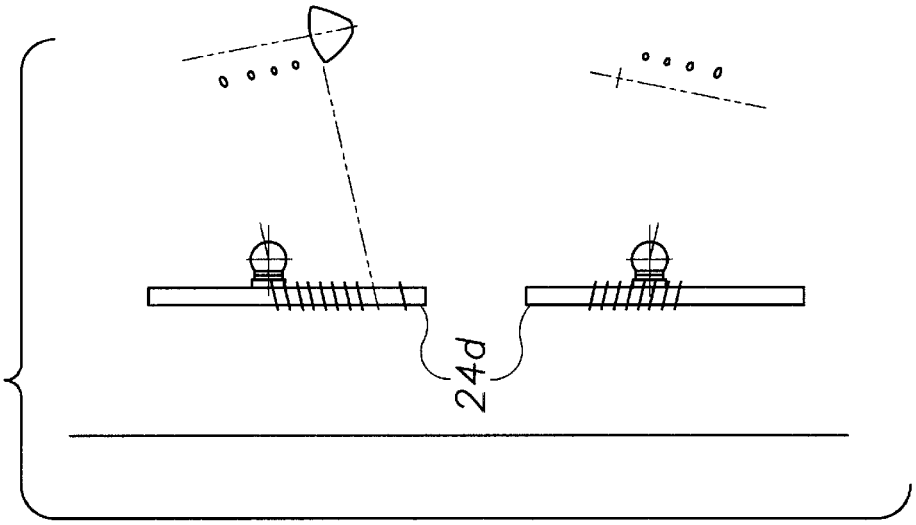
Figure 4C:
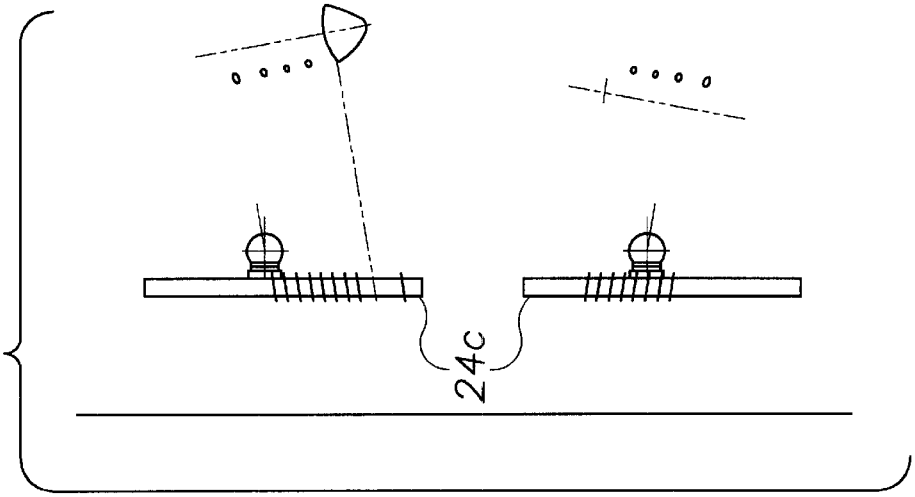

FIG. 2 shows a brushhead 30 with bristle bundles 32. Rows 34 and 36 project out from the handle in intersecting planes. Row 38 includes bristle bundles 32 oriented perpendicular to the brushhead. The bristle bundles in rows 40 and 42 project at opposite angles in planes parallel to that defined by row 38. Large tuft 44 projects from the brush at the same angle as the bristle bundles in row 42. Brushhead 30 is merely exemplary and is only meant to demonstrate that the invention can be exploited for bristle bundles oriented at a wide variety of angles and directions with respect to each other and the brushhead.

FIG. 3 depicts channels through a set of transition plates 24 viewed from three different cross-sections. The channels 22 direct the bristle bundles 32 such that, when they enter the magazine 12, the bristle bundles 32 will not all be perpendicular to the face 21 of the magazine 12. FIG. 3A shows a cross-section across a plane A—A (FIG. 1B), revealing channels 40' and 44' for the bristle bundles 32 in row 40 and tuft 44. FIG. 3B depicts a cross-section across a plane B—B (FIG. 1B), exposing channels 42' and 44' for row 42 and tuft 44. FIG. 3C shows a cross-section across plane C—C, showing, from the top, channels 34', 36', 38', and 40' for rows 34, 36, 38, and 40, respectively.

Just as the bristle bundles 32 cannot be directly fed into the angled channels in magazine 12, the individual transition plates cannot transfer the bristle bundles 32 from one angle into a vastly different one. Instead, a set of individual transition plates 24 is used to gradually orient the bristle bundles. Each transition plate 24 is designed to transition the bristle bundles through a given angle, for example, one or two degrees, The maximum angle a transition plate can guide a bristle bundle through is determined by the thickness of the individual nylon bristle. For example, in the embodiment described in the figures, bristles of about 6–8/1000 in. in diameter are directed through 3° in each transition plate 24. Thicker bristles may be transitioned through as much as 9° in a given transition plate. By arranging a series of transition plates 24*a*, 24*b*, 24*c*, 24*d*, and 24*e* next to each other, the bristles can be guided through a total angle of 15°. FIG. 4 shows two cross-sections of each of the individual transition plates, including channels 40', 42' and 44', and the total angle the bristle bundles will have been guided through after passing through each plate. For example, transition plate 24*a* guides a set of bristle bundles to 3° from perpendicular. Upon entering the second transition plate 24*b*, the bristle bundles are guided an additional 3°, to 6° from perpendicular, Additional plates can be added to guide the bristle bundles through larger angles, and transition plates can be machined with different included angles so that the total angle is not limited to a multiple of three. The largest total angle through which the bristle bundles can be directed is 45°.

The various plates and clamps are attached to each other via dowel pins and bolts which both mount the transition plates 24 to the remainder of the apparatus and prevent the plates from moving with respect to one another in operation. To guide the bristle bundles from one plate to the next, the opening of each channel includes a small chamfer 50. The greater the angle included in the transition plate, the larger the required angle for the chamfer 50. The maximum angle of the chamfer is 45°, and the pitch of the chamfer will partially determine its length. The chamfers minimize the effect of tolerance stackups in the plates. Because the opening of each of the channels 22 has a slightly increased diameter with respect to the remainder of the channel, small misalignments or differences in the channel diameters from one plate to the next will not cause the bristle bundles to jam as they are passed through the various plates.

In operation, the bristle bundle material is passed through channels 22 in the fixed clamp 14, moving clamp 16, and feed clamp 18 before passing into the set of transition plates 24. From the transition plates, the bristles pass into channels in magazine 12. A knife 31 passes between the last transition plate 24 and the magazine 12 along a cut plate 33 opposite face 21 of magazine 12. Alternatively, cut plate 33 may be a component of the last transition plate. The magazine 12 carries the bristle bundles 32 through the remainder of the brush-making apparatus. The bristle bundles are incorporated into the brush handle through an in-mold bristling or a fusion process. An exemplary in-mold bristling process is described in our concurrently filed patent application entitled "Apparatus and Method for Producing Brushware by Injection Molding," the entire contents of which are incorporated herein by reference. Exemplary fusion processes are described in our U.S. patent application Ser. No. 09/465,209, filed Dec. 15, 1999, now U.S. Pat. No. 6,620, 928, and U.S. Pat. No. 4,637,660, the entire contents of both of which are also incorporated herein by reference.

In short, the bristle bundles are carried by the magazine along an apparatus having several stations. At some of these stations, the bristles themselves are processed. Their use-ends are polished and their non-use ends may be melted to fuse the ends of the individual bristle strands in a bundle into a small ball. In addition, the relative heights of the various bristle bundles might be adjusted, or additional bristle strands might be added to individual bristle bundles.

Following the bristle processing, the bristle bundles are attached to a handle. In the in mold process, the -ends of the bristle bundles are projected into a mold cavity and the handle injection molded around the ends of the bristles, encapsulating the ends of the bristles in the brush. In the fusion process, either the ends of the bristles are heated or the head of the brush is heated, or both. The bristles are inserted into holes in the head of the brush, and heated material flows to encapsulate the bristles in the holes. Both of these methods are well known to those skilled in the art. The bristles may also be processed after they have been attached to the remainder of the brush.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method for feeding bristle bundles into a magazine, comprising:

passing the bristle bundle material into a plurality of channels in a feedblock;

passing the bristle bundle material from the channels in the feedblock into corresponding adjacent channels in a first transition plate; and passing the bristle bundle material from the channels in the first transition plate into a set of corresponding channels in the magazine, passing the bristle bundle material from the channels in the first transition plate into a set of corresponding channels in a second transition plate abutting the first transition plate, wherein the channels in the feedblock are parallel to one another, at least a portion of the channels in the first transition plate are not parallel to the channels in the feedblock, and at least a portion of the channels in the second transition plate are not parallel to the corresponding channels in the first transition plate.

2. The method of claim 1, wherein an orientation of at least a portion of the channels in the second transition plate are offset from an orientation of the channels in the feedblock by a first angle and from an orientation of the channels in the first transition plate by a second angle.

3. The method of claim 1, further comprising repeating the step of passing with at least a subsequent transition plate.

4. The method of claim 1, wherein a first portion of the channels in the magazine is skewed with respect to a second portion of the channels in the magazine.

5. The method of claim 1, wherein the channels of the feedblock and the channels of the first transition plate have a first end and a second end, wherein the bristle bundle material passes from the first end of the channels to the second end, and wherein the first end of each of the channel has a chamfer to increase the diameter of a portion of the channel.

6. The method of claim 1, wherein an orientation of a portion of the channels in the first transition plate and an orientation of the corresponding channels in the feedblock are offset by an angle greater than 0°.

7. The method of claim 1, wherein the channels in the first transition plate are not all parallel to one another.

8. The method of claim 1, wherein a first portion of the channels in the magazine is situated in a plane that intersects a plane defined by the second portion of the channels.

9. An apparatus for feeding bristle bundles into a magazine from a supply comprising:

a feedblock;

parallel channels in the feedblock for receiving bristle bundle material from a supply;

a first transition plate abutting the feedblock;

corresponding channels in the first transition plate to receive the bristle bundle material from the channels in the feedblock, wherein at least a portion of the channels in the feedblock are not parallel to the corresponding channels in the first transition plate;

a plurality of additional transition plates interposed between the feedblock and the magazine, wherein the bristle bundle material can be passed from the channels in the feedblock into the corresponding channels in the magazine via the channels in the transition plates, and a portion of the channels in the additional transition plate are not parallel to the corresponding channels in the feedblock or the first transition plate; and corresponding channels in the magazine which receive the bristle bundle material which has been passed through the first transition plate.

10. The apparatus of claim 9, wherein an orientation of at least a portion of the channels in the additional transition plate are offset from an orientation of the channels in the feedblock by a first angle and from an orientation of the channels in the first transition plate by a second angle.

11. The apparatus of claim 9, wherein the channels of the feedblock and the channels of the first transition plate have a first end and a second end, wherein the bristle bundle material passes from the first end of the channels to the second end, and wherein the first end of each of the channels has a chamfer to increase the diameter of a portion of the channel.

12. The apparatus of claim 9, wherein the channels in the first transition plate are not all parallel to one another.

13. The apparatus of claim 9, wherein an orientation of a portion of the channels in the first transition plate and an orientation of the corresponding channels in the feedblock are offset by an angle greater than 0°.

14. The apparatus of claim 9, wherein a first portion of the channels in the magazine is skewed with respect to a second portion of the channels in the magazine.

15. The apparatus of claim 9, wherein a first portion of the channels in the magazine is situated in a plane that intersects a plane defined by the second portion of the channels.

* * * * *